US008628623B2

(12) United States Patent
Bolles et al.

(10) Patent No.: US 8,628,623 B2
(45) Date of Patent: Jan. 14, 2014

(54) METHOD AND PROCESS FOR DRY DISCHARGE IN A PRESSURIZED PRETREATMENT REACTOR

(75) Inventors: John Bolles, Queensbury, NY (US); Joseph Monroe Rawls, Queensbury, NY (US); Bertil Stromberg, Diamond Point, NY (US)

(73) Assignee: Andritz Technology and Asset Management GmbH, Graz (AT)

( * ) Notice: Subject to any disclaimer, the term of this patent is extended or adjusted under 35 U.S.C. 154(b) by 426 days.

(21) Appl. No.: 12/972,625

(22) Filed: Dec. 20, 2010

(65) Prior Publication Data

US 2011/0180061 A1 Jul. 28, 2011

Related U.S. Application Data

(60) Provisional application No. 61/288,520, filed on Dec. 21, 2009.

(51) Int. Cl.
*B01J 3/03* (2006.01)
*B01J 19/00* (2006.01)
*C13K 1/02* (2006.01)

(52) U.S. Cl.
USPC ..... 127/37; 127/1; 162/52

(58) Field of Classification Search
USPC ..... 127/1, 37; 162/52, 60
See application file for complete search history.

(56) References Cited

U.S. PATENT DOCUMENTS

| | | | |
|---|---|---|---|
| 5,617,975 | A | 4/1997 | Johanson et al. |
| 2004/0060673 | A1 | 4/2004 | Phillips et al. |
| 2006/0191651 | A1 | 8/2006 | Bjorkstrom et al. |
| 2007/0037259 | A1 | 2/2007 | Hennessey et al. |
| 2009/0053770 | A1 | 2/2009 | Hennessey et al. |
| 2009/0221814 | A1 | 9/2009 | Pschorn et al. |

FOREIGN PATENT DOCUMENTS

WO WO 2007/064296 6/2007

OTHER PUBLICATIONS

Kim et al., "Pretreatment and Fractionation of Corn Stover by Ammonia Recycle Percolation Process", Bioresource Technology, vol. 96, No. 18, Dec. 1, 2005. pp. 2007-2013, (Abstract Only).

International Preliminary Report on Patentability and Written Opinion of the International Searching Authority issued for International Patent Application No. PCT/US2010/061405 dated Jun. 26, 2012.

*Primary Examiner* — David A Reifsnyder
(74) *Attorney, Agent, or Firm* — Nixon & Vanderhye P.C.

(57) ABSTRACT

A reactor for the treatment of lignocellulosic material and related methods. The reactor includes a vessel having an upper portion and a lower portion. A pressure envelope is formed between an outer wall of the vessel and at least one lower wall of the lower portion of the vessel, and the upper portion of the vessel and the pressure envelope are operatively connected with a pressurization line, such that a pressure of the pressure envelope and a pressure of the upper portion may be equalized.

19 Claims, 1 Drawing Sheet

METHOD AND PROCESS FOR DRY DISCHARGE IN A PRESSURIZED PRETREATMENT REACTOR

CROSS RELATED APPLICATION

This application claims the benefit of application Ser. No. 61/288,520 filed Dec. 21, 2009, which is incorporated in its entirety by reference.

BACKGROUND OF THE INVENTION

The present invention generally relates to producing sugars from biomasses.

In thermochemical processing of biomass, most reaction processes involve a pretreatment step with a humid environment. The biomass pretreatment step typically involves acid hydrolysis or autohydrolysis, in which acid or water is added to the biomass in a pressurized reactor.

In a typical reactor, the material is immersed and soaked in liquid and heated to the desired temperature and pressure via steam and/or other gaseous material. The pretreated material is then discharged through the bottom of the reactor vessel. The acidic conditions in the reactor vessel and the discharge device may require expensive materials of construction for the reactor discharge.

BRIEF DESCRIPTION OF THE INVENTION

In an aspect, the present invention may generally relate to a reactor for the treatment of lignocellulosic material. The reactor may include a vessel having an upper portion and a lower portion. The upper portion (i) may be adapted to receive biomass and may be adapted to pressurize and heat the biomass via a pressurizing gas and (ii) may be defined by at least one upper wail comprising carbon steel. The lower portion (i) may be adapted to receive the pressurized biomass and may be adapted to facilitate the hydrolysis or autohydrolysis of the biomass without excess or free liquid, (ii) may include at least one lower wall made of a corrosion resistant material, and (iii) may be configured to transport the biomass without a transport liquid. The reactor may further include a pressure envelope that is formed between an outer wall of the vessel and a wall of the lower portion. The upper portion of the vessel and the pressure envelope may be operatively connected with a pressurization line, such that a pressure of the pressure envelope and a pressure of the upper portion may be equated.

DETAILED DESCRIPTION OF THE INVENTION

Figure 1A:
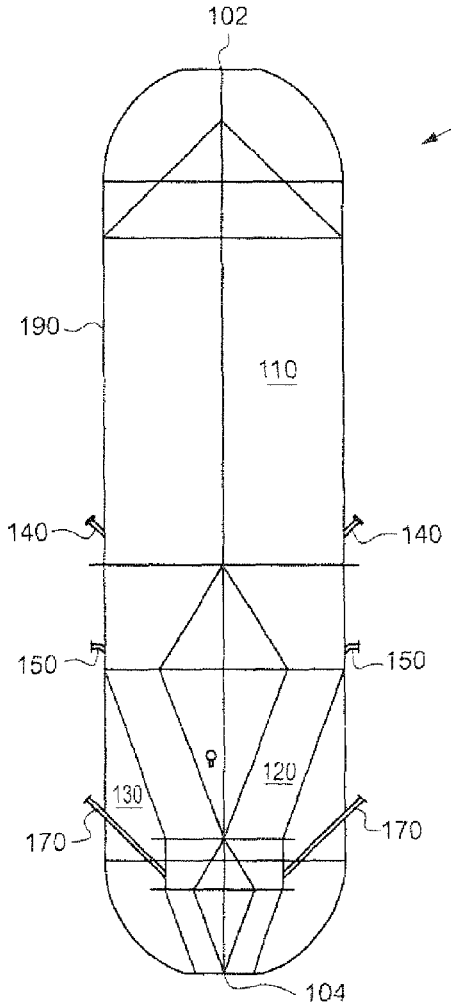
FIGS. 1A and 1B schematically illustrate a reactor vessel according to an embodiment of the invention.

In an aspect, any biomass may be employed in connection with the processes and reactor(s) described herein. For example, the biomass may contain one or more wood(s), grass(es), and/or any lignocellulosic-containing material.

In an effort to overcome the deficiencies of the prior art (e.g., the use of immersion and/or soaking), it may be desirable to improve the efficiency of sugar extraction while reducing the downstream drying and evaporation needs by reducing the liquid in the biomass pretreatment reactor vessel. This reduced liquid environment may be accomplished by using dry conditions with little or no free liquid. But the absence of liquid can cause a unique set of difficulties. In an aspect of the present invention, a reactor design may alleviate the difficulties.

In a dry processing reactor, the reactor vessel generally contains two parts: an upper part and a lower part. The upper part of the vessel is a pressurized section where biomass enters and is heated using steam or other gaseous product (such as ammonia). The wall(s) of the upper portion may be made from carbon steel or stainless steel or another appropriate material.

The ultimate pressure of the vessel is dependent on the heating medium. If steam is used the pressure of the vessel at the desired temperature will be about 5 to 25 bar, but if ammonia is used as the heating medium the operating pressure of the vessel could be up to 60 bar at the desired operating temperature.

It may be possible to use combinations of steam and ammonia and/or other heating medium(s) in certain embodiments of the present invention.

The lower part of the vessel may be a bottom discharge section where the internal pressure exerted on the biomass material is different from the external pressure of the cavity in which the discharge device is located.

To facilitate a proper mass flow, this reactor discharge device could be similar to a Diamondback® chip bin shape, as described in U.S. Pat. No. 5,500,083 (which is incorporated herein by reference), or other one dimensional convergence with side relief, or even other geometric shapes that would allow for smooth discharge of the biomass material without the need for a vibratory or rotary discharge devices. In an aspect, the present invention relies on the geometry of the vessel, rather than external forces (e.g., vibration and/or rotation) to move the biomass.

The geometry of the discharge may be important to proper operation of the vessel so deflection of the discharge device walls must be prevented. Deflection can be prevented by either constructing the discharge portion with very heavy material or providing for the equalization of pressure inside and outside of the discharge region of the vessel. In order to equalize the pressure, a pressure envelop around the discharge device region of the vessel may exist, thereby reducing the distortion of the discharge device material. The pressure envelop may minimize the differential pressure between the outside and the inside of the discharge devices.

This pressure envelope may allow the walls of the discharge device (which may be corrosion resistant material) to be as thin as possible because the walls of the pressure envelop (made of a less costly material such as carbon steel) can withstand the reactor pressure. The corrosion resistant material may be stainless steel, titanium, zirconium, and/or any other corrosion resistant material.

If the pressure envelope is omitted, the metal plates or pieces used in construction of the discharge device become difficult to form and support resulting in a more costly device, especially because they must prevent deflection of and damage to the discharge device. In an aspect, the reactor vessel with the pressure envelope thus advantageously reduces the amount of costly material necessary.

Gas (possibly steam) may be used to heat and pressurize the biomass material in the upper vessel section (i.e., where the thermochemical reactions may be primarily occurring). To equalize the pressure between the reactor vessel and the envelop surrounding the discharge device, the two sections may be connected by a pressure equalization pipe. Gas in the reactor vessel upper section could then fill and pressurize the envelop surrounding the discharge device thereby equalizing the pressure between the inside and outside of the discharge device.

If roughly equalized, the gas in the reactor vessel and the cavity surrounding the discharge device would be at approximately the same pressure, but not have the same function. The gas to the cavity surrounding the discharge device would not be needed to heat the biomass in the discharge device, but merely to maintain pressure. The gas to the upper part of the reactor vessel would be used to heat the biomass as well as maintain the pressure in the vessel.

If condensate of the heating medium is allowed to collect in the pressure envelop, it is possible that there will be a hydrostatic pressure difference between the inside of the discharge device and the cavity (external of the discharge device). To prevent this hydrostatic pressure difference from becoming excessive in the region of the discharge device, it is possible to locate an overflow device in the cavity to maintain a liquid level in the cavity area of the discharge device.

In addition to allowing for equalization of the pressure inside and outside of the discharge section, the cavity—because it may be at or near the temperature of the upper section of the reactor—may be available to supply heat to the reactor contents in an upset condition, such as the loss of gas to the upper section of the reactor. In such a case the heat of the cavity area may become a temporary process heat source to allow for the safe and controlled deactivation of the process reactor. For instance, maintaining a liquid level of the condensate in the pressure envelope (e.g., the cavity) may also provide a heat source in the event that the heating medium is lost temporarily.

If the reactor is slowly deactivated, a rapid and dangerous loss of heat and pressure can be avoided thereby minimizing the danger to operators and equipment.

Figure 1B:
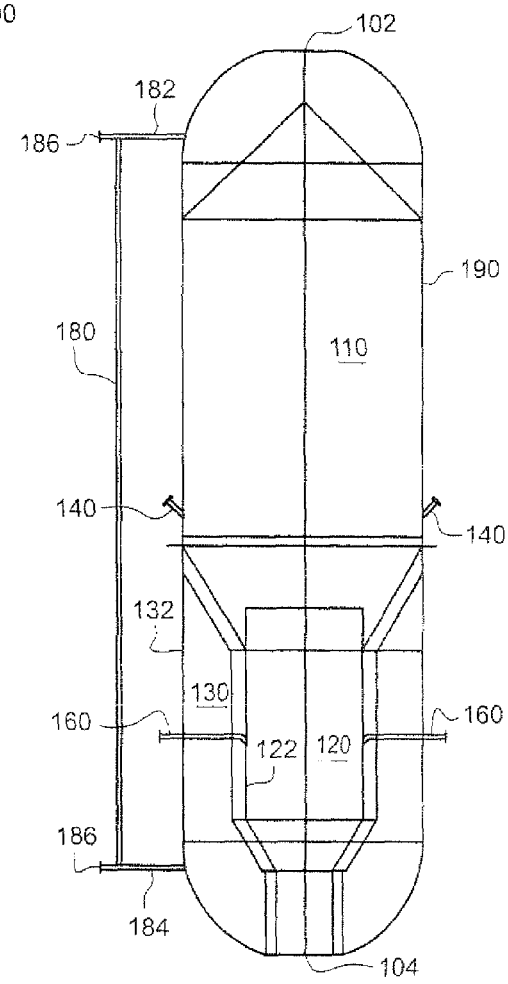

FIGS. 1A and 1B schematically illustrates a reactor in accordance with an embodiment of the present invention. FIGS. 1A and 1B show different views of the same vessel, with like numerals identifying like parts. Vessel 100 is largely defined by outside walls 190 that create a cavity which may be divided into upper portion 110 and the lower portion 120.

Biomass material (e.g., lignocellulosic material) is fed to the top 102 of vessel 100. The biomass may be gravity fed and/or mechanically fed, e.g., via a screw conveyor and/or a conveyor belt. Upon entering vessel 100, the biomass material enters upper portion 110, where ammonia and/or steam pressurizes the reactor without adding excess amounts of liquid. That is, it is preferable that a slurry is not created by the addition of liquid. Process chemicals (e.g., acids that may assist in the hydrolysis reactions) may have been added to the biomass before it enters the vessel. Examples of these acids may include sulfuric, hydrochloric, hydrofluoric, and/or phosphoric acid. Organic acids like acetic acid, formic acid could also be used.

Process inlet nozzles 140 also permit the addition of process chemicals (e.g., acids that may assist in the hydrolysis reactions). Examples of these acids may include sulfuric, hydrochloric, hydrofluoric, and/or phosphoric acid. In an aspect, there may be little to no free liquid in the reactor treatment vessel. That is, the biomass may have little or no excess liquid, because the liquid may be absorbed into the cellulosic material.

Lower portion 120 may be shaped to facilitate transfer of the biomass without external agitation or rotation, e.g., via a Diamondback® chip bin shape, as described in U.S. Pat. No. 5,500,083. Lower portion 120 may be made from corrosion resistant material (e.g., stainless steel, titanium, zirconium, ceramic coating (like a brick lining), a polytetrafluoroethylene lining, or combinations thereof, etc.), and a pressure envelope 130 exists between lower portion 120 and wall 190. As illustrated, the pressure envelope 130 exists between wall 122 of lower portion 120 and wall 132 of vessel 100. Biomass exits the vessel 100 via bottom portion 104.

To facilitate unplugging and reduce clogging, nozzles 150, 160, and 170 are provided. Furthermore, equalization line 180 may equalize pressure between upper portion 110 (via connection 182) and pressure envelope 130 (via connection 184). Pressurization nozzles 186 are provided to facilitate control of the pressure of upper portion 110 and/or pressure envelope 130. In an aspect, pressure envelope 130 permits less material (for example corrosive resistant or other appropriate material) to form the walls of lower portion 120.

Although illustrated and described in connection with a continuous process, the reactor vessel may be used in a batch process.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A reactor for the treatment of biomass, the reactor comprising:

a vessel having an upper portion and a lower portion, wherein the upper portion (i) is configured to receive biomass and is configured to pressurize and heat the biomass via a pressurizing gas and (ii) comprises at least one upper wall, wherein the lower portion (i) is configured to receive the pressurized biomass and is configured to facilitate hydrolysis or autohydrolysis of the biomass without excess or free liquid, (ii) comprises at least one lower wall comprising a corrosion resistant material, and (iii) is configured to transport the biomass without a transport liquid, the vessel further comprising a pressure envelope that is formed between an outer wall of the vessel and the at least one lower wall, the at least one lower wall being inside the vessel, and wherein the upper portion of the vessel and the pressure envelope are operatively connected with a pressurization line, such that a pressure of the pressure envelope and a pressure of the upper portion may be equalized.

2. The reactor according to claim 1, wherein the lower portion is configured to transport the biomass without external agitation or rotation.

3. The reactor according to claim 1, wherein the corrosion resistant material comprises stainless steel, titanium, zirconium, a corrosion-resistant alloy, a ceramic coating, a polytetrafluoroethylene lining, or combinations thereof.

4. The reactor according to claim 1, wherein the upper portion is configured to pressurize the biomass up to a pressure of about 5 to 25 bar where the pressurizing gas is steam.

5. The reactor according to claim 1, wherein the upper portion is configured to pressurize the biomass to a pressure of about 60 bar where the pressurizing gas is ammonia.

6. The reactor according to claim 1, wherein the upper portion comprises carbon steel.

7. A method of hydrolyzing a biomass material, the method comprising the steps of:

feeding biomass material to a vessel having an upper portion a lower portion, and a pressure envelope formed between an outer wall of the vessel and at least one lower wall of the lower portion, the at least one lower wall of the lower portion being inside the vessel;

pressurizing the biomass in the upper portion using a pressurizing agent;

transferring the pressurized biomass to the lower portion in which hydrolysis or autohydryolsis reaction occurs without excess or free liquid; and transferring the hydrolyzed biomass from the lower portion without introduction of a transport liquid; and equalizing a pressure of the pressure envelope and a pressure of the upper portion via a pressurization line that connects the pressure envelope and the upper portion of the vessel.

8. The method of claim 7, wherein the step of feeding the biomass material is performed continuously.

9. The method of claim 7, wherein the step of feeding the biomass material is performed is a batch-wise process.

10. The method of claim 7, wherein the pressurizing agent comprises ammonia and wherein the step of pressurizing the biomass in the upper portion results in a pressure of up to about 60 bar.

11. The method of claim 7, wherein the pressurizing agent comprises steam and wherein the step of pressurizing the biomass in the upper portion results in a pressure of about 5 to 25 bar.

12. The method of claim 7, wherein the step of transferring the hydrolyzed biomass from the lower portion further occurs without external agitation or rotation.

13. The method of claim 7, wherein the hydrolysis reaction occurs with the addition of sulfuric, hydrochloric, hydrofluoric, phosphoric acid, or a combination thereof.

14. The method of claim 7, wherein the hydrolysis reaction occurs with the addition of acetic acid, formic acid, or a combination thereof.

15. The method of claim 7, wherein the hydrolysis reaction occurs with the addition of sulfuric acid.

16. The method of claim 7, wherein the biomass comprises wood, grass, or a combination thereof.

17. The method of claim 7 further comprising the step of feeding the biomass to the vessel via gravity.

18. The method of claim 7 further comprising the step of feeding the biomass to the vessel via a screw conveyor or a conveyor belt.

19. The method of claim 7 further comprising maintaining a condensate level in the pressure envelope so as to provide a heat source.

* * * * *